US008220095B2

(12) United States Patent
Schultz et al.

(10) Patent No.: US 8,220,095 B2
(45) Date of Patent: Jul. 17, 2012

(54) HIGHWAY OVERPASS BRIDGE MODIFICATION SYSTEM AND METHOD

(75) Inventors: Randall C. Schultz, Acworth, GA (US); Michael Waters, Atlanta, GA (US); Charles Keit Tipton, Marietta, GA (US)

(73) Assignee: Skanska USA Civil Inc., Whitestone, NY (US)

( * ) Notice: Subject to any disclaimer, the term of this patent is extended or adjusted under 35 U.S.C. 154(b) by 187 days.

(21) Appl. No.: 12/696,940

(22) Filed: Jan. 29, 2010

(65) Prior Publication Data

US 2011/0188929 A1 Aug. 4, 2011

(51) Int. Cl.
*E01D 21/00* (2006.01)

(52) U.S. Cl. ..... 14/77.1; 14/73; 14/73.1; 14/73.5; 14/74; 14/74.5; 14/77.3; 52/745.19; 52/745.2

(58) Field of Classification Search ..... 404/1, 75; 14/73–75, 77.1–78
See application file for complete search history.

(56) References Cited

U.S. PATENT DOCUMENTS

| | | | | |
|---|---|---|---|---|
| 3,391,620 | A | 7/1968 | Mahoney | |
| 3,654,652 | A * | 4/1972 | Pleasants | 14/18 |
| 3,794,433 | A * | 2/1974 | Schupack | 404/1 |
| 3,811,147 | A * | 5/1974 | Dix | 14/2.4 |
| 3,906,687 | A * | 9/1975 | Schupack | 52/87 |
| 3,958,890 | A | 5/1976 | Ferrari | |
| 4,181,995 | A * | 1/1980 | Zur | 14/77.1 |
| 4,185,440 | A * | 1/1980 | Finsterwalder | 52/745.19 |
| 4,313,383 | A * | 2/1982 | Parazader | 104/124 |
| 4,900,193 | A * | 2/1990 | MacKinnon | 405/252 |
| 5,090,176 | A * | 2/1992 | Kishida et al. | 52/745.2 |
| 5,577,284 | A * | 11/1996 | Muller | 14/73 |
| 5,846,020 | A * | 12/1998 | McKeown | 404/1 |
| 6,345,403 | B1 * | 2/2002 | Nagle | 14/77.1 |
| 6,347,424 | B1 * | 2/2002 | Vatne | 14/69.5 |
| 6,453,494 | B1 * | 9/2002 | Koglin | 14/41 |
| 6,561,727 | B1 * | 5/2003 | Gustafson, Jr. | 404/1 |
| 6,676,330 | B2 | 1/2004 | Stamm et al. | |
| 6,701,562 | B2 * | 3/2004 | Burke et al. | 14/46 |
| 6,795,992 | B2 | 9/2004 | Markelz | |
| 6,857,156 | B1 | 2/2005 | Grossman | |
| 7,478,450 | B2 | 1/2009 | Fong | |
| 7,784,228 | B2 * | 8/2010 | Gustafson | 52/176 |

FOREIGN PATENT DOCUMENTS

| | | |
|---|---|---|
| JP | 08-003921 | 9/1996 |
| KR | 1020030012013 | 2/2003 |
| KR | 1020060075508 | 4/2006 |

* cited by examiner

*Primary Examiner* — Raymond W Addie
(74) *Attorney, Agent, or Firm* — K&L Gates LLP

(57) ABSTRACT

An example method of expanding a highway have a multiple lanes passing under a highway overpass bridge having a center pier is described. The center pier may be between lanes passing in opposite directions. The center pier may be replaced with two replacement central piers having a gap there between. Additional lanes may be added through the gap between the replacement central piers. Various methods of construction and detailed designs for such bridges are also described.

34 Claims, 23 Drawing Sheets

Detail 1
Collector
Beam

Transverse Section at Load Transfer Section B/5

HIGHWAY OVERPASS BRIDGE MODIFICATION SYSTEM AND METHOD

BACKGROUND

Limited access roadways are generally built on grade spanning other roadways, railroads, waterways and other natural impediments. Roads and rail facilities also traverse over limited access roadways on overpass bridge structures. The typical overpass bridge is supported with a center pier located in the middle of the limited access roadway, the center pier supports beams that span between the end abutments. The center pier structure and beams supports the bridge deck, which facilitates transportation vehicles. Bridge beams are designed to react to dead and live loads at prescribed locations along the beam. Beams are either simply supported (support at each end of the beam), or continuously supported (supports impart a moment into the beam). The height clearance of overpass structures are standardized by statute for vehicle, types to maintain a safe minimum vertical clearance. Typical overpass bridge sections are referenced in the figures enumerated below.

Many urban environments are experiencing rapid traffic growth on limited access roadway facilities. Overpass structures generally limit the capacity to expand limited access roadways. In particular, expansion of these facilities is limited by the originally designed overpass span lengths. Moreover, most overpass bridges over roadways that need expansion are well within their useful life and have not achieved their overpass traffic capacity. Therefore, expansion of limited access roadways, beyond the original build out design, may cause the removal and reconstruction of overpass bridges before the end of their useful life. Other factors also limit the expansion of limited access roadways such as right-of-way cost, budget restrictions and environmental impacts.

Transportation agencies are seeking alternative forms of transportation that mitigate cost and environmental impacts, while providing additional capacity and enhancing commuter travel time.

DETAILED DESCRIPTION OF EXAMPLE EMBODIMENTS

Figure 1:
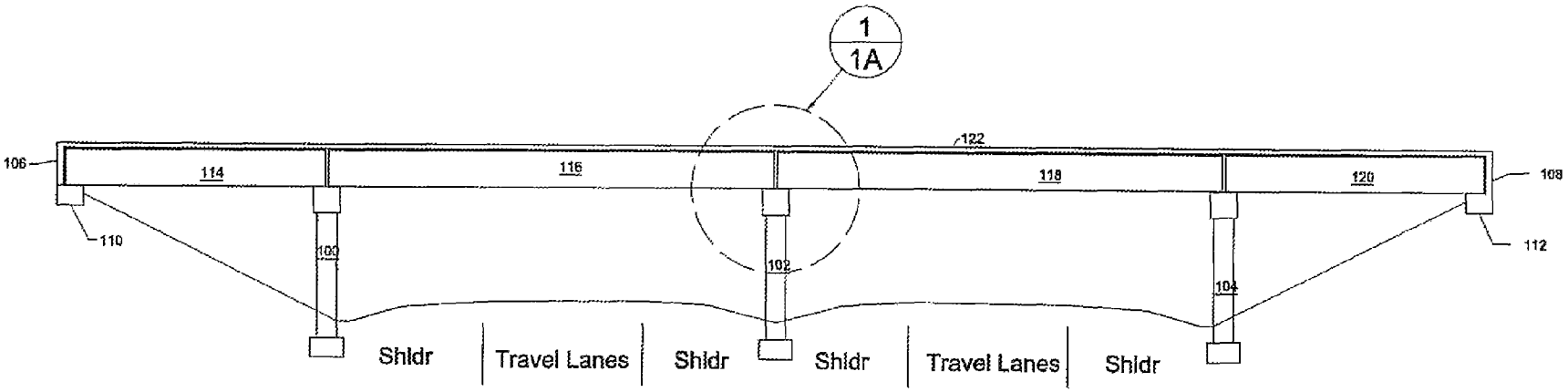
FIG. 1 illustrates a simply supported overpass bridge configuration spanning a limited access roadway with median.
Figure 1A:
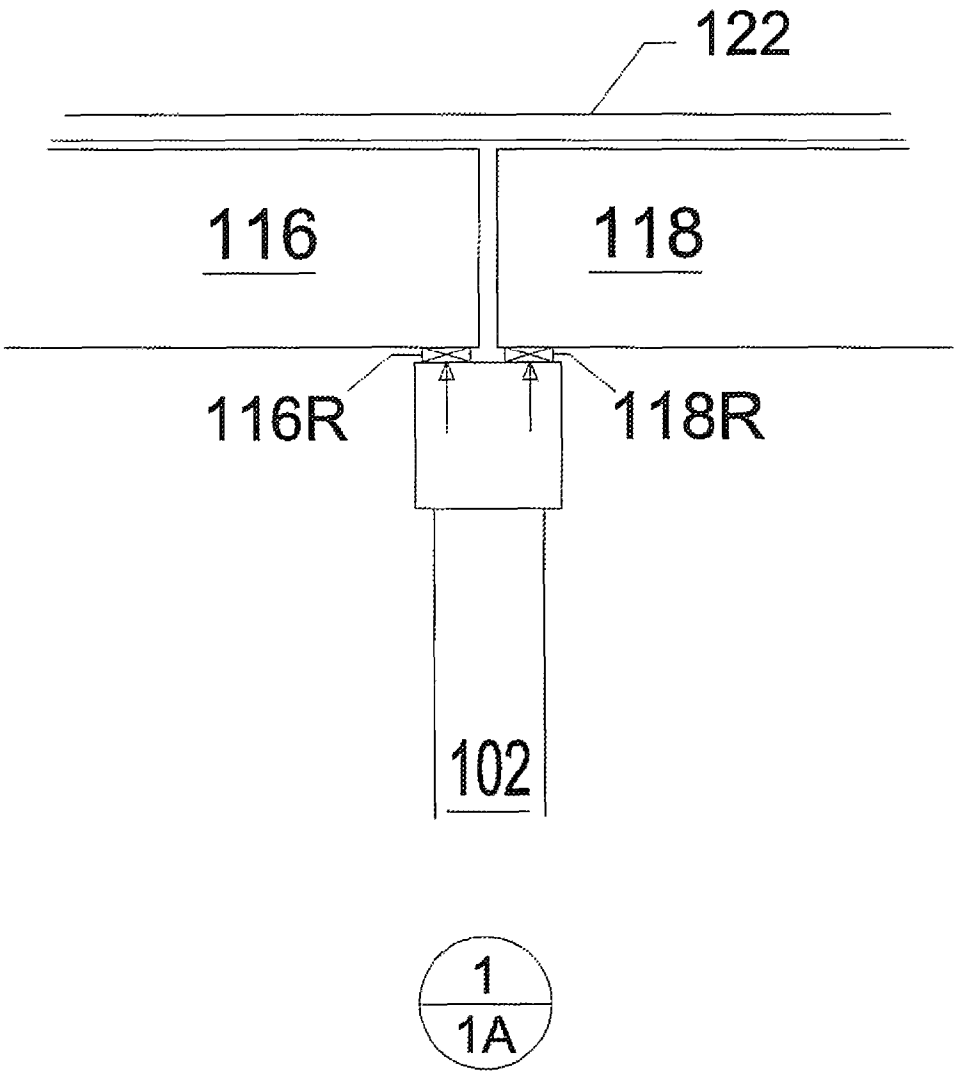
FIG. 1A illustrates a more detailed view of the beam reaction points in the bridge of FIG. 1.

Managed lane facilities, such as separate high occupancy vehicle lanes or toll lanes, and other sources of transportation are seen as viable solutions for growing urban traffic congestion. These systems may achieve optimum economy when placed in the center of the limited access roadway. The center pier of the typical overpass bridge however, obstructs this transportation corridor.

In some example embodiments described herein, the center pier obstruction for centerline transportation systems may be replaced, for example, by two separated piers with traffic flowing between them, without removing the overpass bridge deck or constructing a new bridge. Some of these examples introduce two new piers to the standard overpass configuration, which reduces the clear span of the existing overpass bridge and provides a dedicated transportation corridor along the center of the limited access roadway. In some of these examples, existing bridge span may be reduced without changing the configuration of the superstructure or vertical clearance of the bridge. Illustrative examples are discussed in more detail below for both simply supported and continuous span bridge types, however, it will be appreciated that the principles described are more generally applicable and are not limited to the particular examples.

One example embodiment of the present invention includes a procedure for expanding a highway having existing lanes in a first direction and a second opposite direction. The lanes pass under an existing highway overpass bridge having a center pier located between the two sets of lanes, and a first fixed bridge support on a first outer side outwards from the first set of lanes, and a second fixed bridge support on a second outer side outwards from the second set of lanes. The example procedure includes replacing the center pier with two replacement central piers having a gap there between. The example procedure further includes adding at least one additional lane between the first set of lanes and the second set of lanes, passing through the gap.

Optionally, at least two additional lanes may be added in the gap between the two replacement central piers. Optionally, the at least one additional lane is a bidirectional lane, configured to allow traffic direction to be changed between the first direction and the second direction. Optionally, the first and second sets of lanes and the at least one bidirectional lanes all run substantially perpendicular to a longitudinal axis of the bridge deck. In some examples, the center pier may be replaced without replacing the deck of the overpass bridge. The at least one additional lane may added without relocating the first and second fixed bridge supports. Optionally, wherein the at least one additional lane is a toll lane, even if the first and second sets of lanes are not toll lanes. Alternatively, the at least one additional lane may be a high occupancy vehicle (HOV) lane.

Optionally, when the existing bridge is a simple span bridge, a collector beam may be installed at the center point in support of the existing span beams. The collector beam may be supported by a needle beam, which is in turn supported by the two replacement central piers.

Optionally, where the existing bridge is a simple span bridge, the beams may be joined at the central point by a splice to form a continuous span bridge.

In one more particular example, where first set of lanes is 3 regular lanes and a HOV lane, and the second set of lanes is 3 regular lanes and a HOV lane, the at least one additional lane may be two or more bidirectional lanes, created by eliminating the HOV lanes in the first and second sets of lanes. Optionally, the at least one additional lane may be two bidirectional lanes, or alternatively three bidirectional lanes.

Another example embodiment of the present invention is a highway overpass bridge produced by any of the above example procedures.

Another example embodiment of the present invention is a highway overpass bridge having a bridge deck, a first set of lanes running in a first direction under the bridge deck, a second set of lanes running in a second opposite direction under the bridge deck, a pair of bridge piers located between the first set of lanes and the second set of lanes, and at least one bidirectional lane running between the pair of bridge piers under the bridge deck.

Optionally, the first set of lanes, the second set of lanes and the at least one bidirectional lane run substantially perpendicular to a longitudinal axis of the bridge deck. The at least one bidirectional lane may be a high occupancy vehicle (HOV) lane, a toll lane, or a non-toll lane.

Optionally, where the bridge is a simple span bridge, the center point of the span may be supported by a collector beam. The collector beam may supported by a needle beam, and the needle beam may in turn be supported at each end by a respective one of the pair of bridge piers. Alternatively, where the bridge is a continuous span bridge, the continuous span may be formed by splicing at the center point two beams that previously formed a simple span bridge.

FIG. 1 illustrates a typical simply supported overpass bridge configuration. Piers 100, 102, and 104 support the bridge superstructure. These piers may represent multiple piers at the same position along the longitudinal axis of the bridge, or a single center pier with the beams spanning the entire width of the bridge. The ends of the bridge 106 and 108 and supported by abutments 110 and 112. The example bridge may have four beam sections, beam 114, spanning from the abutment 110 to pier 100, beam 116 spanning from pier 100 to pier 102, beam 118 spanning from pier 102 to pier 104, and beam 120 spanning from pier 104 to abutment 112. The beams may be, e.g., steel or precast concrete beams. Bridge deck 122 may be positioned atop of and be support by the beams. Multiple travel lanes passing under the overpass bridge, between piers 100 and 102 in one direction, while similar travel lanes pass between pier 102 and 104 in the opposite direction.

It will be appreciated that Piers 100, 104 limit the widening of the travel lanes under the overpass bridge illustrated in FIG. 1. Moreover, even if there were additional space, right of way issues near the bridge may also constrain widening of the travel lanes.

Detail 1 of FIG. 1 demonstrates the typical existing reaction points for beams 116, 118 at the center pier location. Center pier loads are transferred from the bridge deck 122, to the beams 116, 118 to their support piers. Simply supported beams are generally designed for this reaction point. In some circumstances, for simply supported structures, a change in the reaction point is likely to cause beam failure. Particularly for concrete beams, points of support cannot be moved in many cases, even if the effective span is reduced, because the forces applied to the beam change in ways that may cause a beam failure, particularly under live load. Some example embodiments described herein may transfer the loads of the existing beams to the new pier locations without compromising the integrity of the bridge superstructure. Furthermore, the loads may be transferred within the existing beam networks, without impacting the vertical clearance of the existing structure. For continuous span structures, a change in the reaction point may safely distribute the loads into the beam section of the existing beam design or may only need minor reinforcement for shear and moment forces.

Figure 2:
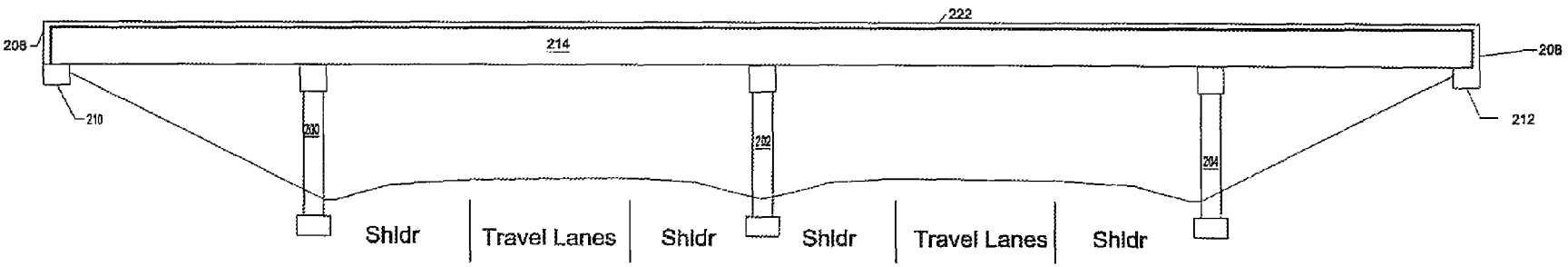
FIG. 2 illustrates a continuous beam overpass bridge spanning a limited access roadway with median.

FIG. 2 illustrates a continuous beam overpass bridge. Piers 200, 202, and 204 support a continuous span 214 from left end 206 atop abutment 210 to the right end 208 atop abutment 212. The bridge deck 222 is supported by the continuous span beam. The continuous span may use steel beams, precast post-tensioned concrete beams, or box beams. As in the simple span, described above, existing travel lanes passing under the overpass bridge go in one direction between piers 200 and 202, and in the other direction between piers 202 and 204. Also, as previously described, piers 200, 204 may limit the ability to widen the bridge or travel lanes.

Figure 3:
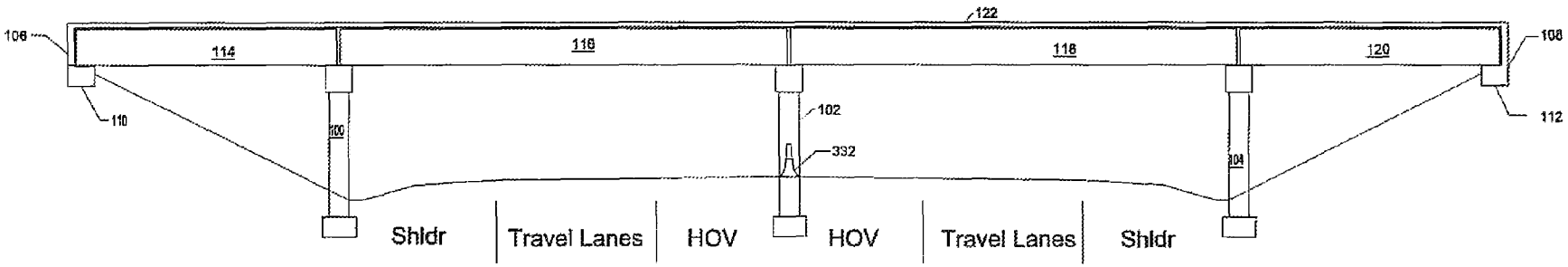
FIG. 3 illustrates a simply supported overpass bridge over a limited access highway with centerline HOV build out.

FIG. 3 illustrates a simply supported overpass bridge configuration for a limited access highway built out to include center line restricted High-Occupancy Vehicle (HOV) lanes. The structure is substantially the same as the structure previously illustrated in FIG. 1. However, HOV lanes are provided between the regular travel lanes and the center pier, in place of the central shoulder. A divider 332 may be provided between the HOV lanes traveling in opposite directions, particularly if there is no center shoulder.

It can be appreciated that overpass bridges and limited access roadways may take various forms and combinations to which example embodiment of the present invention may be applied. Some example embodiments described here address the modification of (a) bridges supported by beams that are simply supported by the central support pier and (b) bridges supported by beams that develop a moment across the top of the center pier, e.g., a continuous beam. These two general types of bridges may be further divided into categories by the material that the beams are constructed from; concrete or steel. Some example embodiments include Concrete Simply Supported, Steel Simply Supported, and Pre-cast Post-Tensioned Concrete Continuous Span across Center Support and Steel Continuous Span across Center Support. While these examples are described in general they apply to standard manufacture specifications for concrete and steel member types (e.g. ASHTOH precast members, Standard Steel member design manual), and other uniquely designed beam member types. Also while these examples are presented, it will be appreciated that the techniques described herein may be applied in modifications to other types of structures, e.g., in truss bridges, cable stayed or suspension bridges, or other applications, each appropriately tailored for the particular structure being modified.

Figure 4:
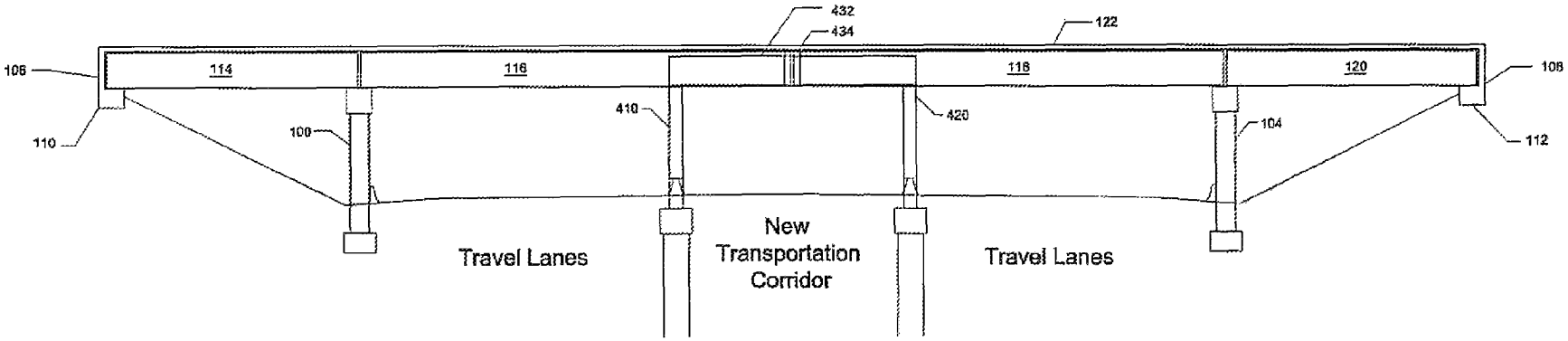
FIG. 4 illustrates an example modified simple span overpass bridge using steel or precast beams, according to an example embodiment of the present invention.

In each of the examples presented, a new transportation corridor is provided centrally under the bridge, in the general vicinity of a central pier which is removed. New support piers may be constructed at the outer limits of the new transportation corridor, which may coincide approximately with the inner limits of the existing transportation corridors. The new support piers may be sufficiently spaced and equidistant from the existing center pier FIG. 4 illustrates an example modified overpass bridge, according to an example embodiment of the present invention. The bridge illustrated in FIG. 4 is a simple span bridge using steel or concrete beams, and may be constructed by modifying the simple span bridge illustrated in FIGS. 1,2 and 3. The modifications described may provide support for the existing simply supported reaction point using a collector beam for either steel or concrete beam bridges, or for a steel bridge, using a slice plate. It will be appreciated that alternative approaches to providing support may also be employed, e.g., other structures that transfer loads from the center reaction points to the new support piers. It will also be appreciated that similar approaches may be used in bridges with more than a single center support, e.g., to divide the loads on multiple existing piers, or in positions other than the bridge center.

Since modifying the support structure for simply supported beams may require that the beam support location must remain unchanged, an alternative support may need to be provided if the center pier is removed. One approach is to construct a transverse collector beam along the existing longitudinal beam reaction points, e.g., the existing reaction points previously depicted in detail 1 of FIG. 1 as 116R, 118R. The collector beam may operate as a continuous beam providing vertical and horizontal support at the center pier location for all longitudinal beams 116 and 118. The new collector beam may be constructed within the vertical limits of the existing beams above the existing pier.

Figure 5:
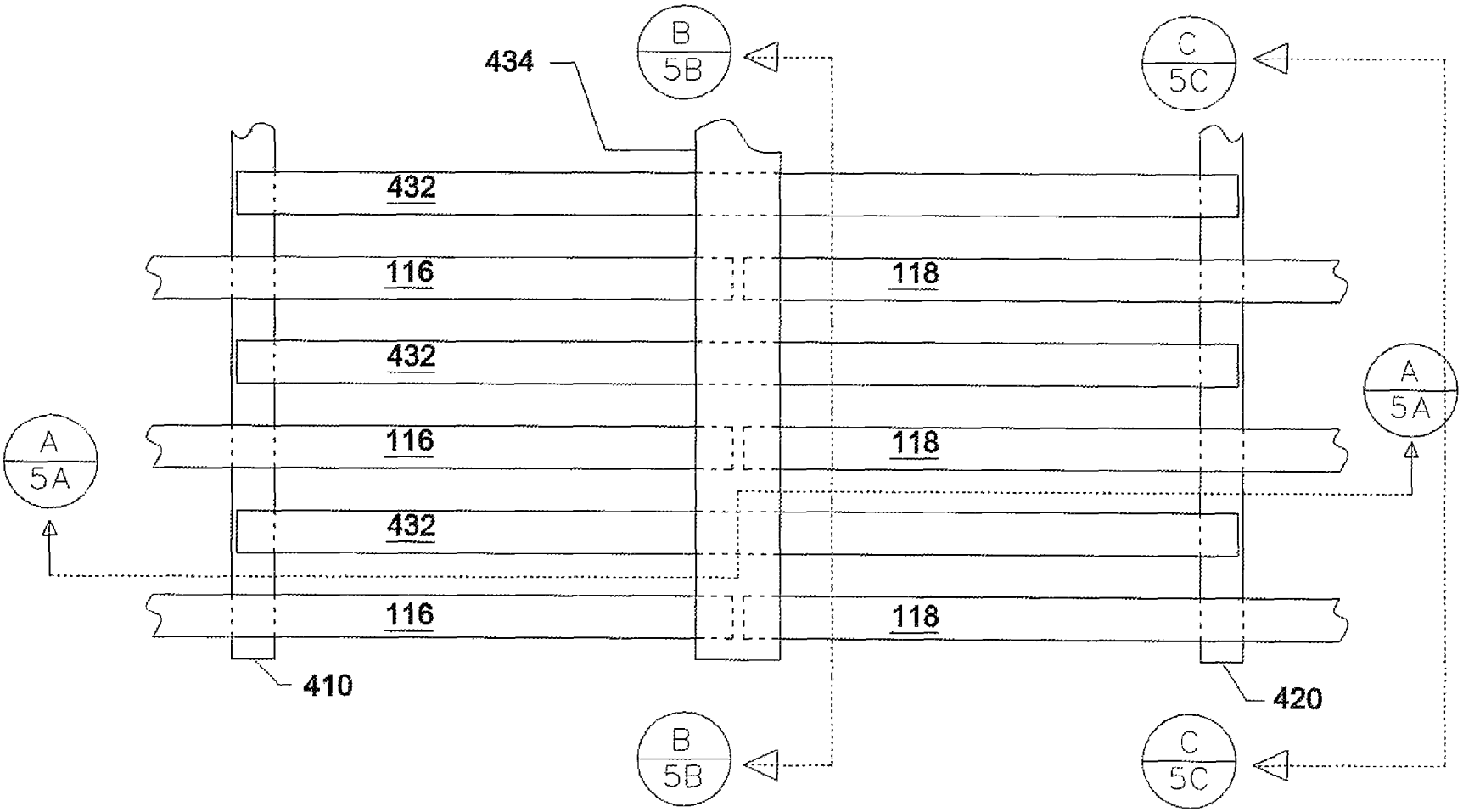
FIG. 5 illustrates a plan view of the collector and needle beam configuration in the example modified bridge of FIG. 4, according to an example embodiment of the present invention.
Figure 5A:
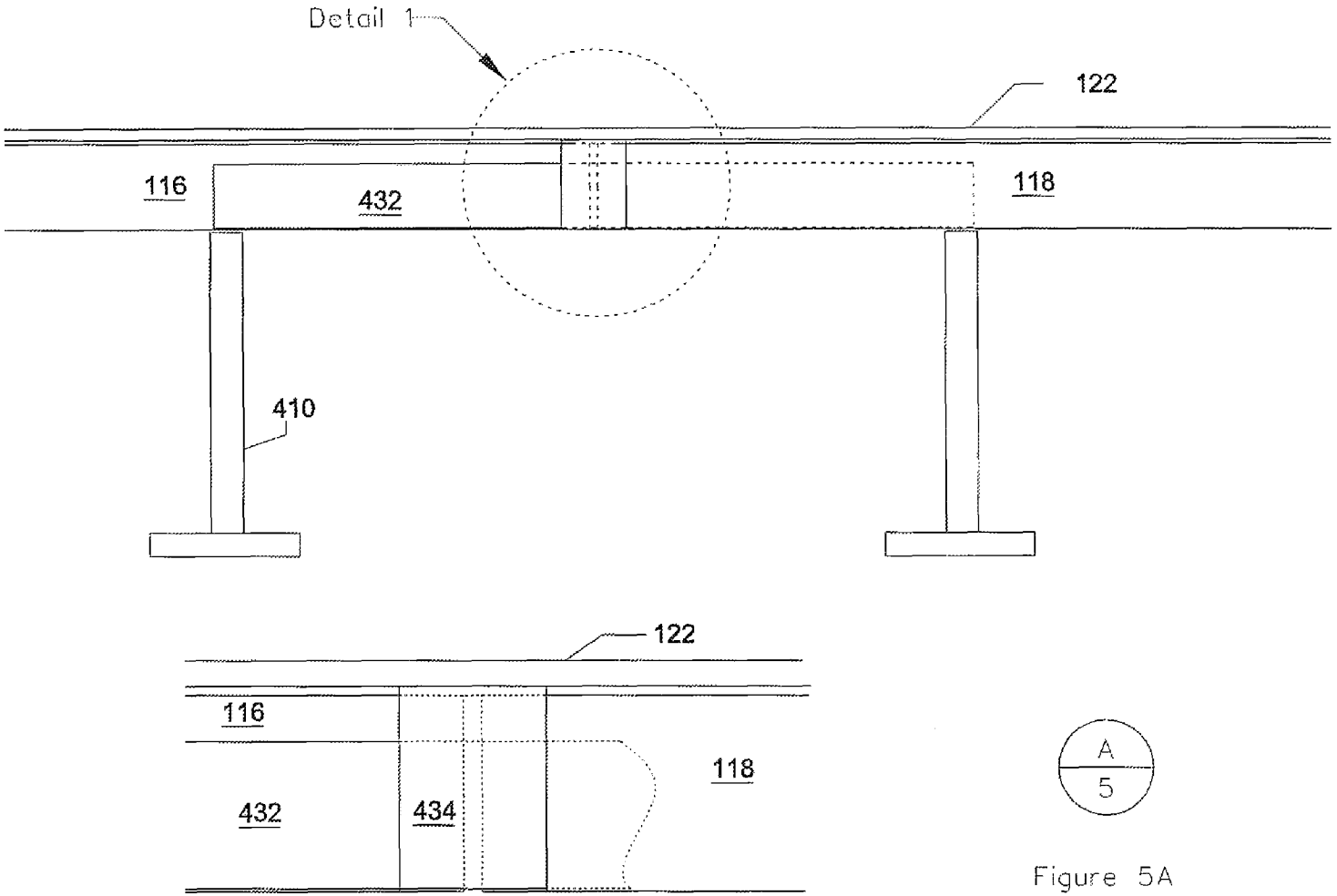
FIG. 5A illustrates elevation view at Section A of the collector and needle beam structures in example modified bridge of FIG. 4, according to an example embodiment of the present invention.
Figure 5B:
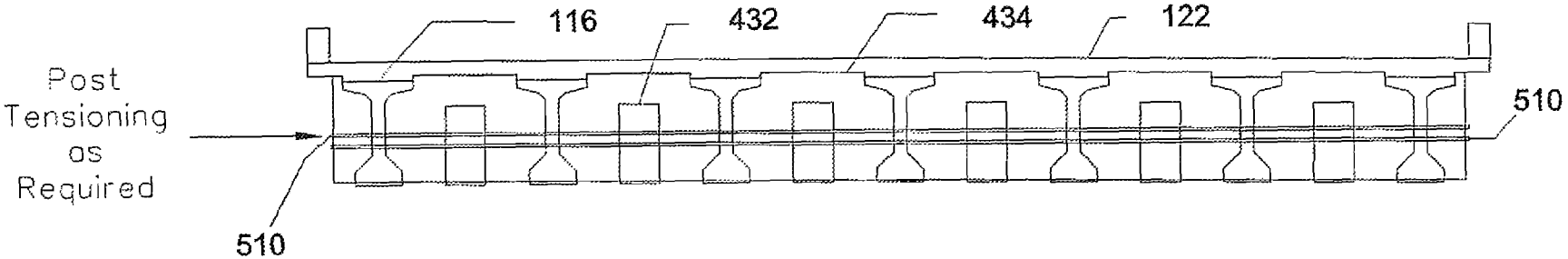
FIG. 5B illustrates an elevation view at Section B of the collector beam configuration with sections of needle beams and the existing bridge beams in the example modified bridge of FIG. 4, according to an example embodiment of the present invention.
Figure 5C:
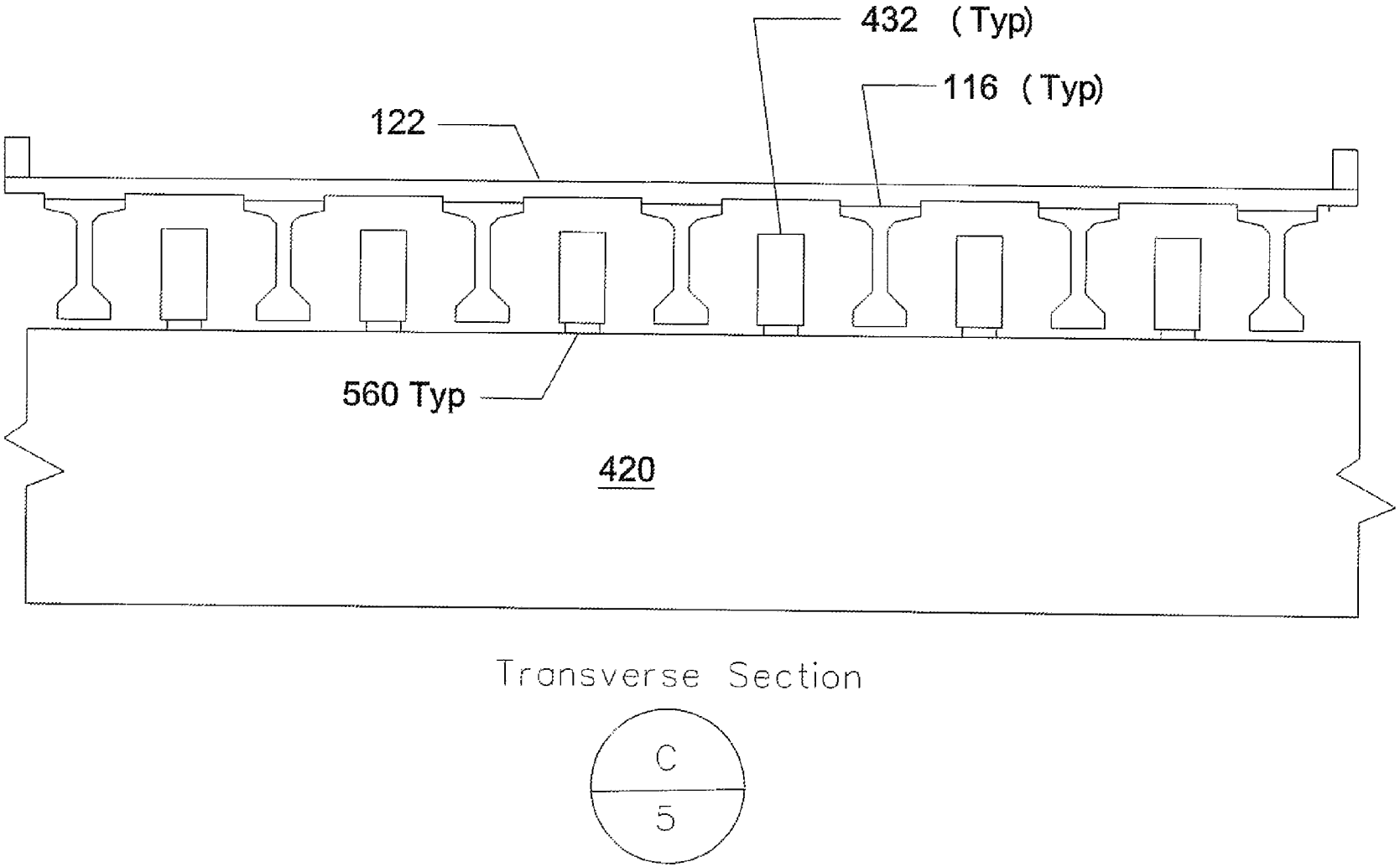
FIG. 5C illustrates a view of a new pier at Section C with existing and needle beam configurations in the example modified bridge of FIG. 4, according to an example embodiment of the present invention.

The two outer piers 100 and 104 and two outer beams 114 and 120 are unchanged. New, separated piers 410 and 420 are added in place of original central pier 102. Beams 116 and 118 are still supported at their outer ends by original piers 100 and 104. They may be directly supported by the new piers 410 and 420. However, if beams 116 and 118 are completely supported by these new piers, the new reaction forces may cause the beams to fail. Accordingly, a central support may need to be provided. The central beam reaction points (116R, 118R) may still need to be supported at the original central support point where the center pier has been removed. To accomplish this, a collector beam 434 may also be added in a transverse orientation along the center point as depicted in plan view of FIG. 5. This transverse beam may "collect" the center pier forces (the forces at reaction points 116R, 118R) and transfer them through the needle beam 432 that may span between and be supported by piers 410 and 420. The needle beam may be designed to support the collector beam as a mid-beam moment, simply supported at piers 410 and 420, as discussed below with respect to FIGS. 5 and 5A. Alternatively, for a steel-beamed bridge, a splice may be used, as described in more detail below. A steel splice plate at the center pier location will adjoin beams 116 and 118 as one continuous beam, as discussed below with reference to FIGS. 6 & 6A the slice plate may support the changed reactions of shear and moment forces when the center pier is replace by the new support piers 410 and 420. Beam shear may be assessed and provided for at the new pier locations (410, 420). A new transportation corridor, for example for toll, HOV, bus lanes, or railway lines may be provided between piers 410 and 420. In particular, a bi-directional toll lane may be provided.

An approach to cure problems caused by the change in reaction points for steel beam and concrete beam members may be treated differently because their member properties are materially different. Steel retains high tensile and compression properties, which allows for efficient beam sections that can absorb force changes to its original design. Consequently, steel plate and shear reinforcement modifications may cure a change in reaction locations. Conversely, concrete has excellent compression properties but tensile strength is limited, generally requiring steel reinforcement and/or prestress design considerations. Concrete members lack efficient sections and must be designed for the loads intended. A change in the reaction point to a concrete member generally has a significant impact upon member stability due to concretes' tensile limitations. Therefore, a change in reaction points for concrete members typically requires a transfer of loads from its original end points so that the member reacts as intended.

FIGS. 5, 5A, 5B, and 5C illustrate, various plan and elevation views of an example collector and needle beam structure in the example modified span bridge previously illustrated in FIG. 4. Collector beam 434 loads may be transferred to new piers 410 and 420 through the needle beams 432. The needle beams may be installed longitudinally, threaded between the existing girders 116 and 118 and may span between the new support piers 410 and 420. The needle beams 432 may incorporate the collector beam and may effectively react as continuous beams between the new pier supports 410 and 420. The needle beams support the collector beam, which supports the existing longitudinal beams as originally intended. Alternatively, the needle beams may support the collector beam from below, although this may result in a change in clearance. In either case, the forces from the bridge deck, which previously were passed from the beams to the center pier, are now passed by the original beams to the collector beam, and from their through the needle beams to the new separated piers 410 and 420.

As indicated in the table below, for existing concrete beams, the collector beams may be provided using any of a range of beam design types.

TABLE 1.1

| | Existing Beam material | |
|---|---|---|
| | Steel | Concrete |
| a<br>Collector Beam Design | | |
| Reinforced Concrete with Post Tension Design | X | X |
| Reinforced Concrete Design | X | X |
| Composite steel/Reinforced Concrete Design | X | X |

TABLE 1.1-continued

| | Existing Beam material | |
|---|---|---|
| | Steel | Concrete |
| Steel Design | X | |
| b | | |
| Needle Beam Design | | |
| Precast Concrete with post tension design | X | X |
| Reinforced Concrete with Post Tension Design | X | X |
| Reinforced Concrete Design | X | X |
| Composite Steel & Concrete Design with Post Tension option | X | X |
| Steel Design | X | X |

Collector and needle beam designs will vary subject to existing conditions, client preference and constructability. For example, a collector beam and needle beam may be formed and placed in concrete and stressed in the transverse and longitudinal direction by a post tensioning system 510. Alternatively, the collector beam may be formed and placed in concrete encasing the longitudinal precast needle beams. Needle beams may be a whole member or placed as partial members prior to casting the collector beam. A post tension system 510 may stress the collector beam in a transverse manner and the needle beams in a longitudinal manner.

Figure 6:
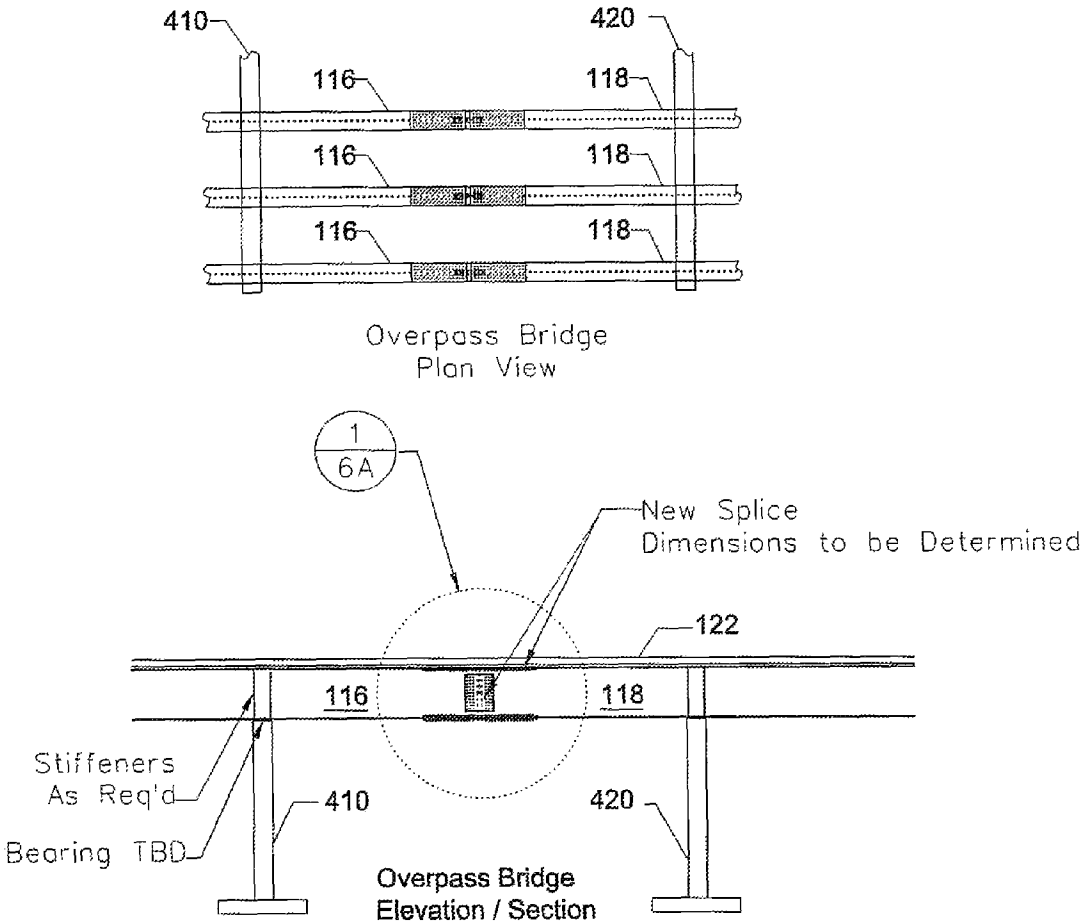
FIG. 6 illustrates an example plan and elevation view of a bolted splice in the modified simple span overpass bridge of FIG. 4 using steel beams, according to an example embodiment of the present invention.
Figure 6A:
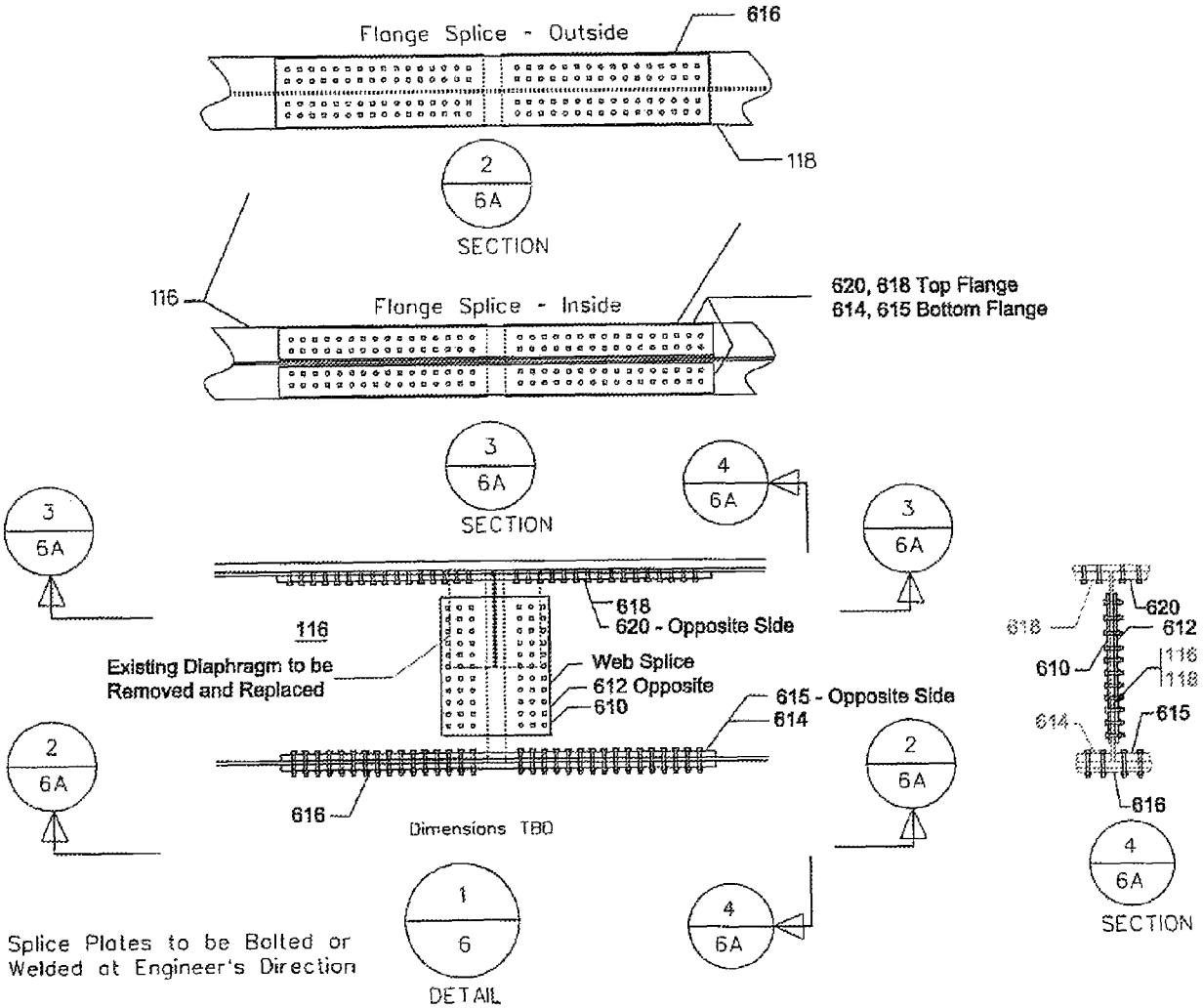
FIG. 6A illustrates example elevation detail A and flange details B and C of a bolted splice, in a the modified simple span overpass bridge using steel beams, according to an example embodiment of the present invention.

In an alternative example, instead of using a collector beam, a simple beam bridge may be retrofitted by splicing the existing beams to form a continuous beam bridge. For example, the existing beams may be joined by splice plating the beams at the centerline location and modifying the beam for the changed shear and moment forces. This may be suitable, in particular for a steel beam simple beam bridge, but probably not for various types of concrete beam bridges. FIG. 6 and detail 1 of FIG. 6A illustrates an example metal plate splice of a steel beam. Existing steel beams 116 and 118 may be joined using steel plate 610, with holes tapped in the existing steel beams to allow bolting of the two beams via a splice plate or plates. A corresponding plate 612 (not shown) may be provided on the opposite side of the beam. In addition to the plate or plates located on the lateral sides of the beams, plates 614 and 615 (not shown) may be provided above and below the bottom flange of the beam. Plates 618 and 620 (not shown) may be similarly provide on the top flange of the beam FIG. 6A illustrates a detailed example modification of a simple span steel bridge structure using a bolted splice, according to an example embodiment of the present invention. Plates 610 and 612 are bolted together on the lateral sides of the steel beams. Plates 614 and 615 (not shown) sandwich the existing bottom flange with plate 616. Plates 618 and 620 are screwed into the top flange. Alternately plates may be welded in place at the desecration of the client.

Figure 7:
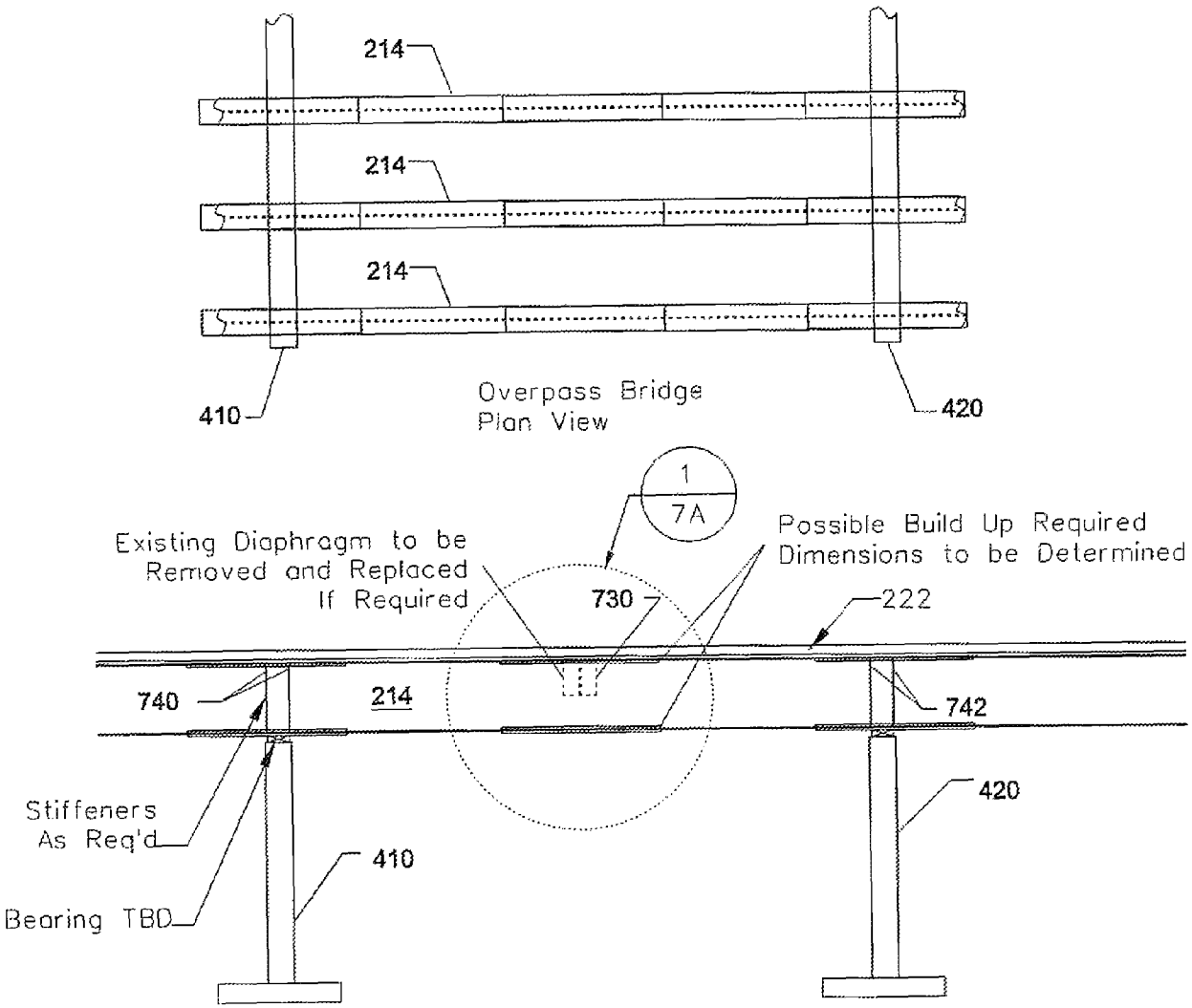
FIG. 7 illustrates an example plan and elevation view of a modified continuous steel beam bridge, according to an example embodiment of the present invention.
Figure 7A:
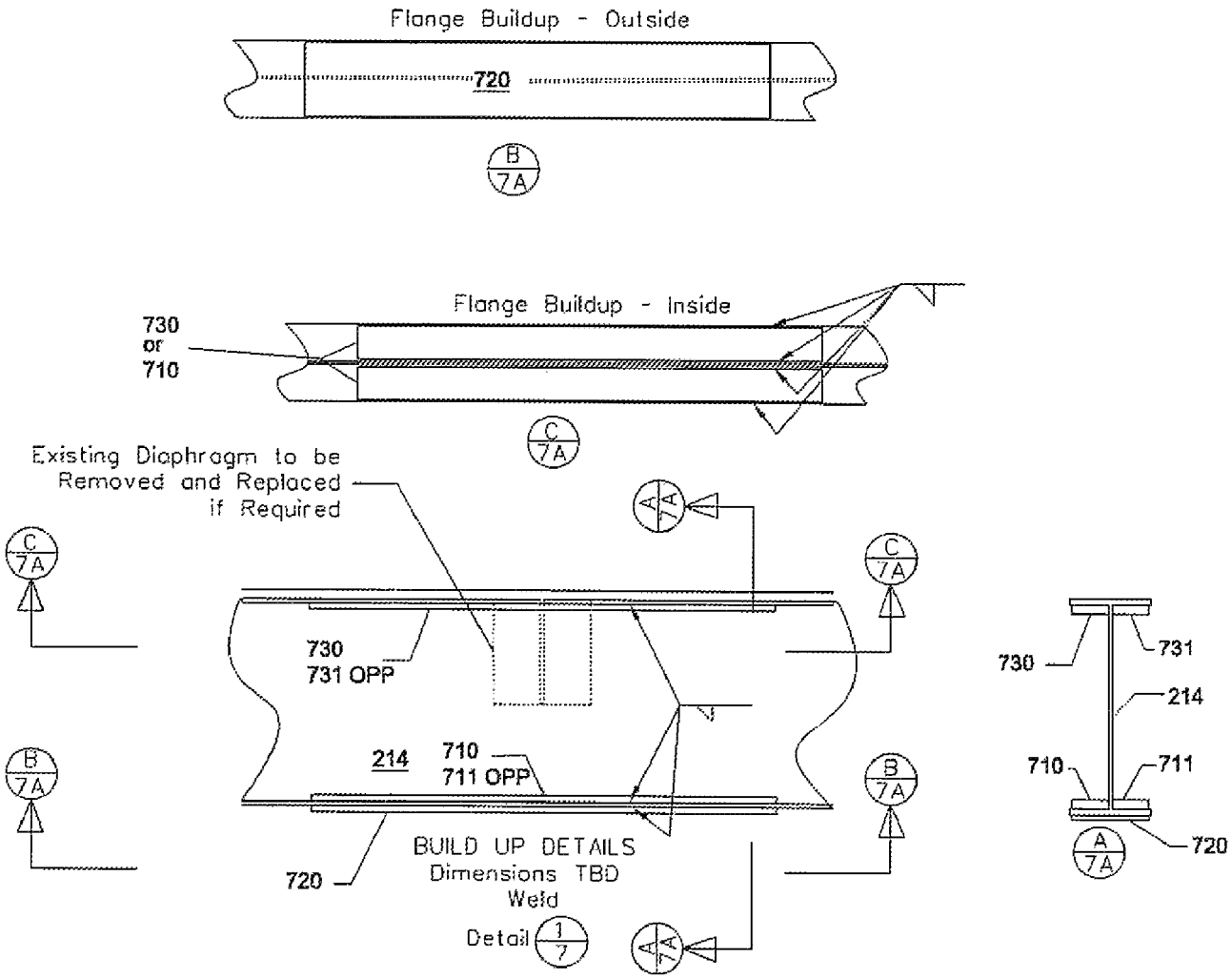
FIG. 7A illustrates an example elevation detail A and plan sections B and C of a modified continuous steel beam bridge, according to an example embodiment of the present invention.

FIG. 7 illustrates an example modified continuous steel beam bridge, according to an example embodiment of the present invention. Continuous steel beam 214 remains. New piers 710 and 720 may be provided in place of the original central pier. In the continuous steel beam bridge, additional stiffeners 740 or diaphragms 730 may be provided so the continuous beam 214 can safely react to changed moment and shear forces at the new reaction points on piers 410 and 420. Continuous beam sections are typically uniform and may not require additional reinforcement at the center pier location. However, FIG. 7A depicts a detail of the continuous steel beam at the center pier location. Plates 730, 731 and 710, 711 and 720 are welded to the existing top and bottom beam flanges respectively.

Even in the continuous span bridge, a collector beam assembly may optionally be provided to deal with shear and moment forces due to the new pier reaction points. The table below describes design options subject to the type of bridge modification.

| | Existing beam material | |
|---|---|---|
| Existing Beam Modification Design | Steel | Concrete |
| Steel Design | X | |
| Post Tension Modification Design | | X |
| Fabric Reinforced Design | | X |

It will be appreciated that the example procedures for bridge widening may be used in many contexts, and for other types of bridge designs. They may be particularly suited, e.g., for replacing an existing HOV roadway footprint with a managed lane tolling facility without reconstructing the over pass bridge structures and adding road lanes. Because toll lanes provide steady revenue, which may be securitized in some circumstances, the invention may provide needed capital savings for the development of managed lane toll system utilizing revenue sourced bonds. Simply stated, the cost of modifying a bridge is significantly lower than the cost of replacing an overpass bridge with a new bridge configuration that utilizes the same bridge abutments. When coupled with an increase of the number of usable road lanes that may be tolled, the existing roadway facility can be expanded and paid for by securitizing the new tolled facility.

It will be appreciated that this approach may also be used to reconfigure overpass bridge structures not only for centerline managed lane, but also for HOV, rail or other transportation needs. One possible advantage of many of the example embodiments described herein are that the transportation facility can be added without materially impacting existing roadway traffic. For example, many of the structures described above do not require replacement of the bridge deck, resulting in minimal traffic distribution on the road passing over the overpass.

Figure 8:
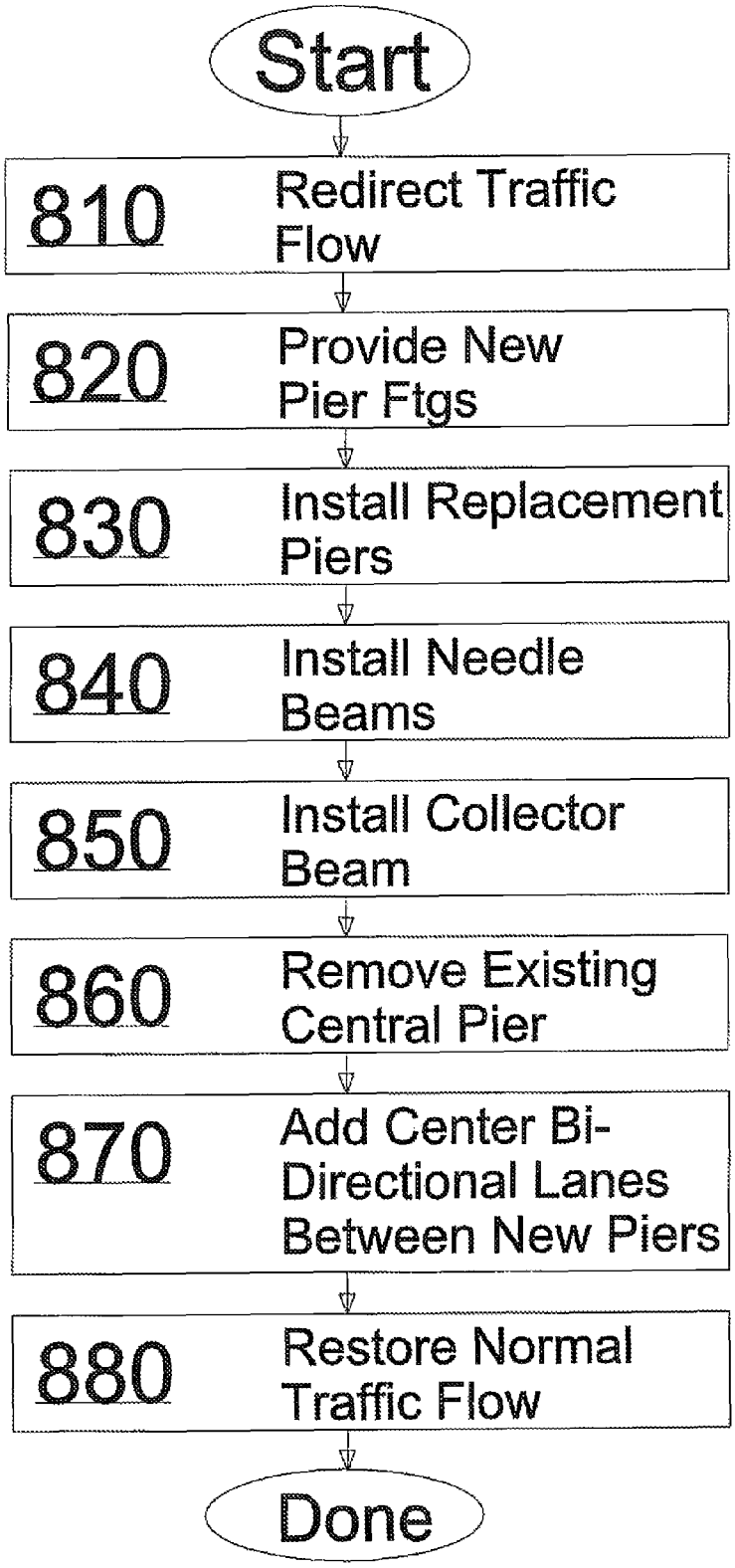
FIG. 8 illustrates an example procedure for modifying an existing highway to provide increased capacity, according to an example embodiment of the present invention.

A further advantage of some of the example described above is that the existing bridge structures may be reconfigured while still maintaining existing clearance heights The example methods may be applied to simply supported ASHTOH beams, simply supported steal beams, or continuous beam bridge configurations of either steel or concrete design FIG. 8 illustrates a flowchart for an example procedure for modifying a conventional simply supported overpass bridge configuration, according to an example embodiment of the present invention. In the example procedure, the highway passing under the bridge may have a set of lanes in a first direction and a second set of lanes running in a second, opposite direction. The lanes may pass under a highway overpass bridge having a center pier located between the first and second sets of lanes. The existing bridge may have a first fixed bridge support on a first outer side outwards from the first set of lanes, and a second fixed bridge support on a second outer side outwards from the second set of lanes.

In 810 traffic may be redirected, e.g., by closing the inner HOV lanes in each direction.

In 820, footings for the new piers may be provided. It will be appreciated that the construction zone may only need to be extended slightly beyond the position of the new piers, allowing the outer traffic lanes to continue to operate throughout all or at least most of the example construction procedure.

In 830, two new replacement central piers may be installed. A gap may be provided between the replacement piers for the provision of new central lanes passing between the new piers, e.g., bidirectional toll or HOV lanes.

In 840, needle beams supported by the new piers may be installed between the existing girder structure of the bridge deck.

In 850, a collector beam, supported by the needle beams may be added to support the existing central reaction points of the simple span. If necessary, the collector beam structure may be post-tensioned. The collector beam may be made with a variety of materials, as discussed previously in the examples above.

In 860, the center pier may be removed. When the center pier is removed, the bridge deck load that was previously supported by the center pier may be supported by the collector beam, which is in turn supported by the needle beams, and the new piers. The existing central pier may be replaced by the new piers without replacing the deck of the overpass bridge and without relocating the first and second fixed bridge supports.

In 870, at least one additional lane may be added between the first set of lanes and the second set of lanes, the at least one additional lane passing through the gap between the new piers. For example, two or three bidirectional HOV or toll lanes may be added between the central piers. If the original outer lanes are not toll lanes, appropriate infrastructure for toll handling may also need to be added elsewhere on roadway.

In 880, normal traffic flow may be restored, e.g., with 2 lanes of normal traffic in each direction and two or 3 new bidirectional center lanes.

It will be appreciated that the example procedure described above may be modified for a continuous beam bridge configuration, as well as based on actual configuration of the limited access roadway and maintenance of traffic requirements. Other minor modifications of the example procedure may be made depending on the particular bridge design, traffic and site conditions, customer requirements, etc.

Figure 9:
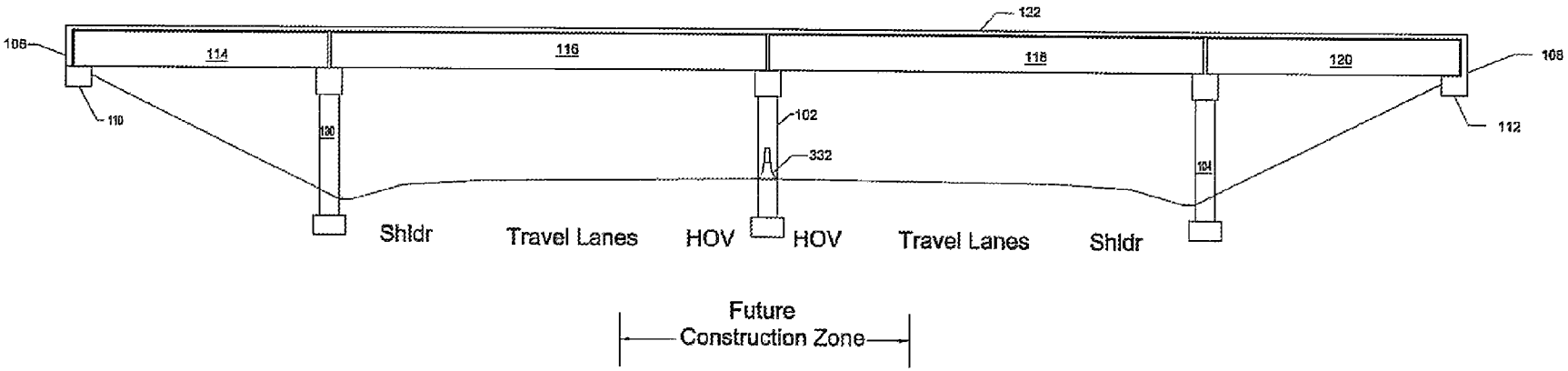
FIGS. 9-9E illustrate a bridge at various stages of an example of procedure for modifying an existing highway to provide increased capacity, according to an example embodiment of the present invention

FIG. 9 illustrates a conventional simply supported overpass bridge with full median build out to allow HOV lanes on each side of the median barrier, according to an example embodiment of the present invention. A construction zone depicted in the drawing into which later details will be illustrated.

Figure 9A:
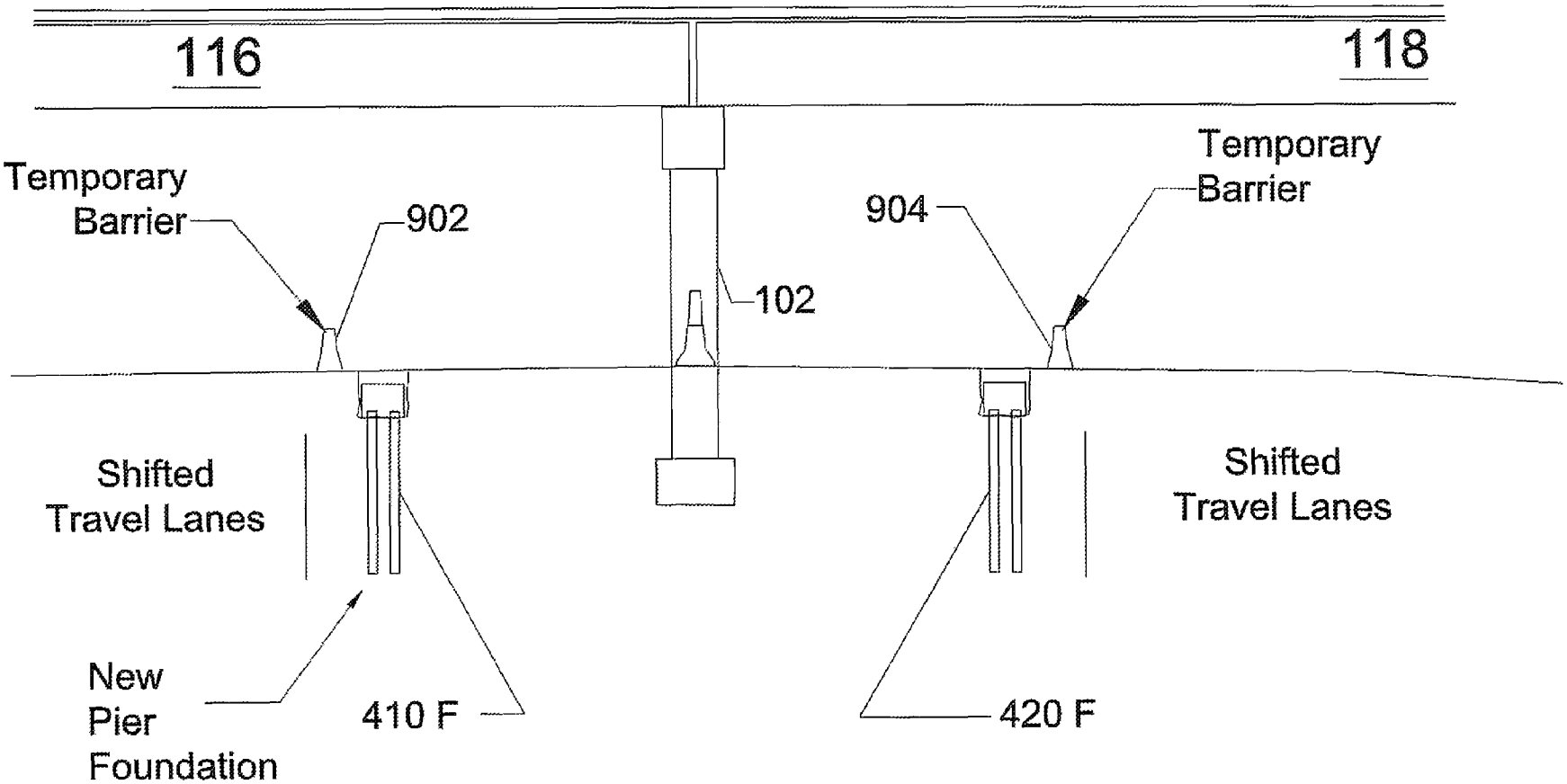

FIG. 9A depicts an example construction zone, according to an example embodiment of the present invention. In the example construction zone, the existing travel lanes have been shifted outwards to provide the construction zone, which is demarked between temporary barriers 902 and 904. Traffic in the outer lanes may proceed normally at most times during the construction process, safely separated by the temporary barriers. The new pier foundations 410F and 420F may be constructed with limited headroom installation techniques. This may allow the entire modification procedure to proceed without altering the existing bridge deck position and dimensions.

Figure 9B:
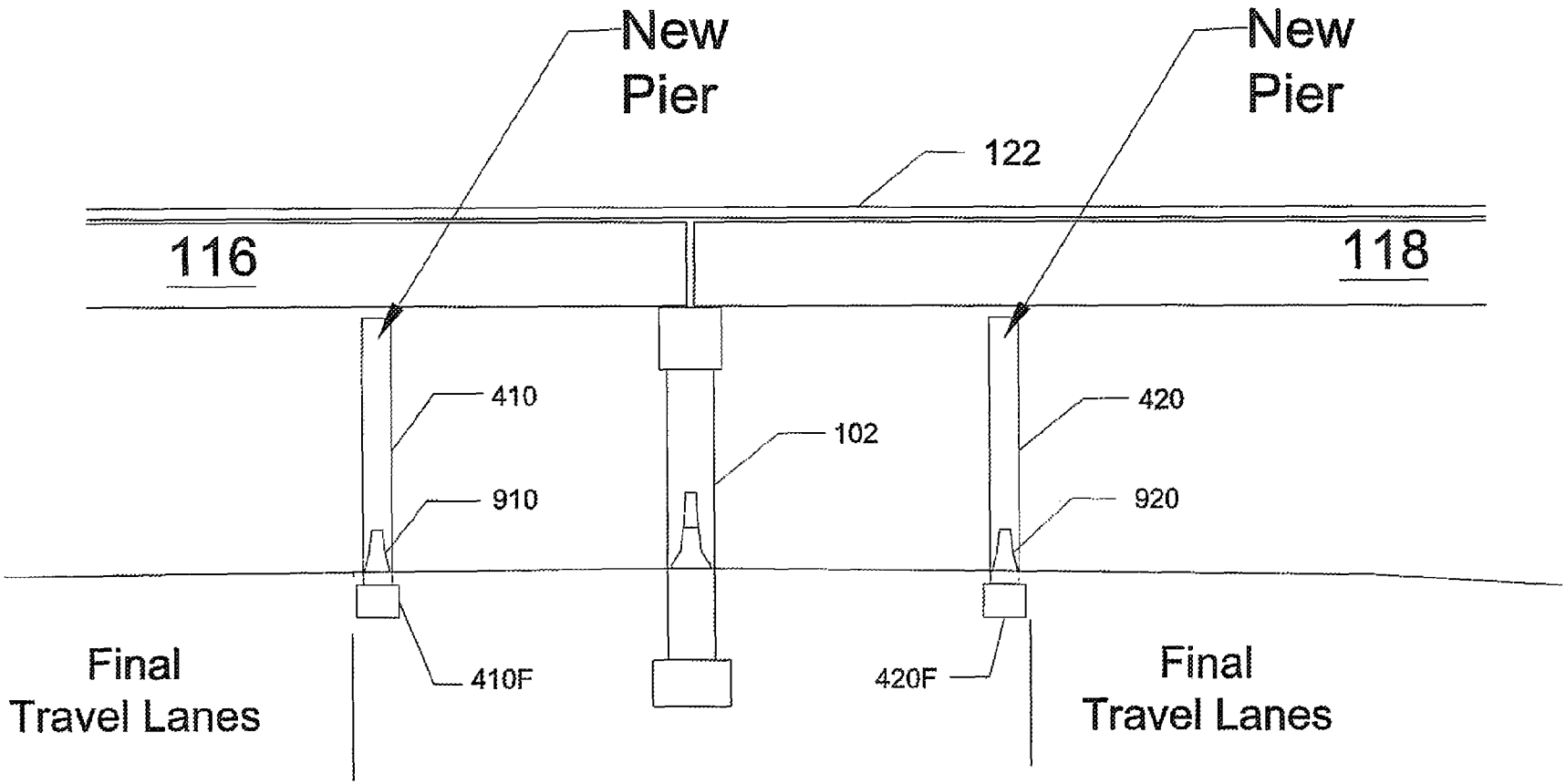

In FIG. 9B, the new support piers and new traffic separation barriers have been installed. The new support piers 410 and 420 are placed on foundations 410F and 420F respectively. The separation barriers 910 and 920 allow traffic to proceed in the outermost lanes, while reducing the amount of distance required separating traffic in the outermost lanes from the bidirectional or HOV central lanes.

Figure 9C:
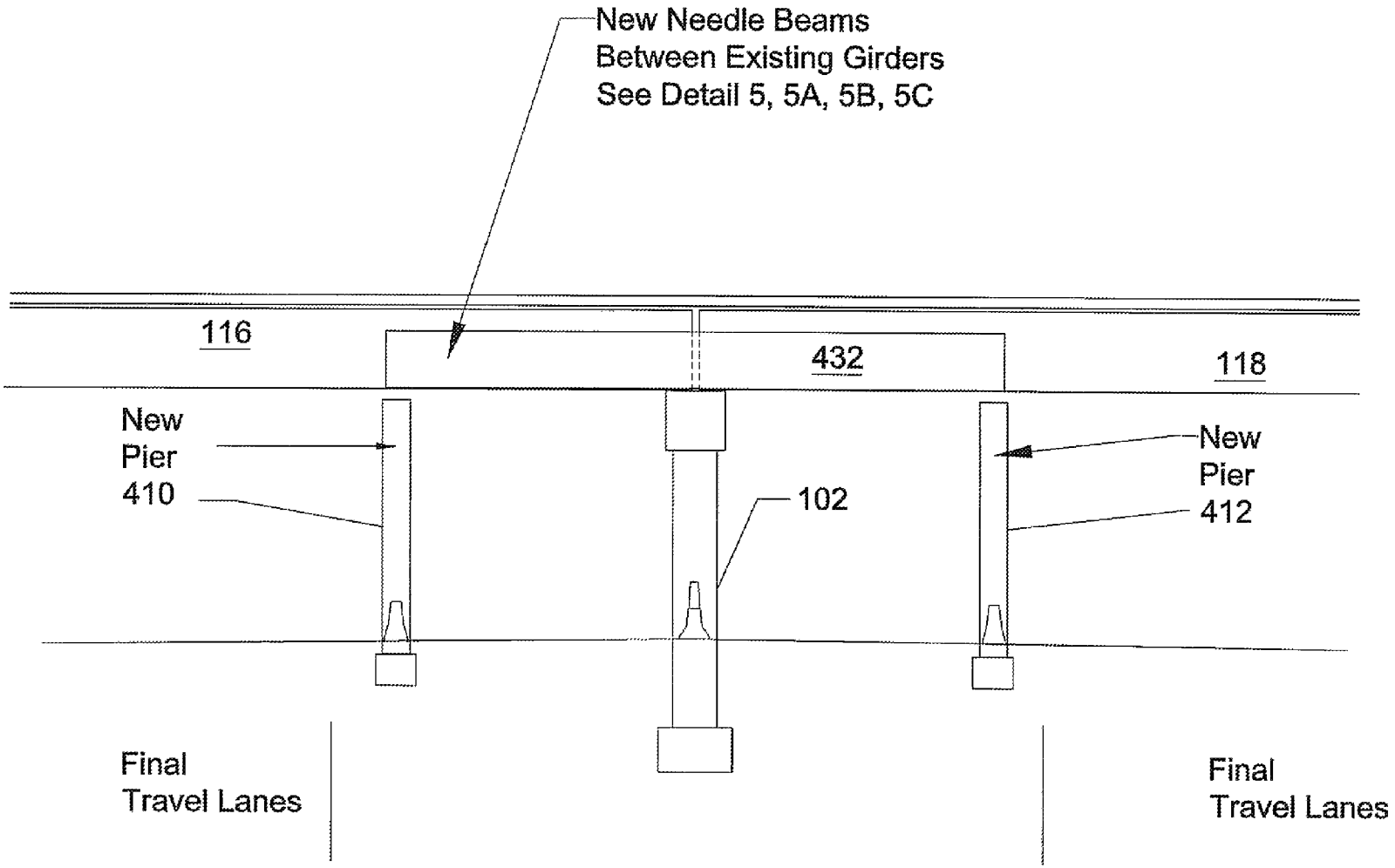

FIG. 9C depicts the new needle beams installed. The needle beams 432 span between new piers 410 and 420 above the existing center pier 102. The new needle beams are placed longitudinally between the existing bridge beams 116 and 118 that were previously illustrated in FIG. 5.

Figure 9D:
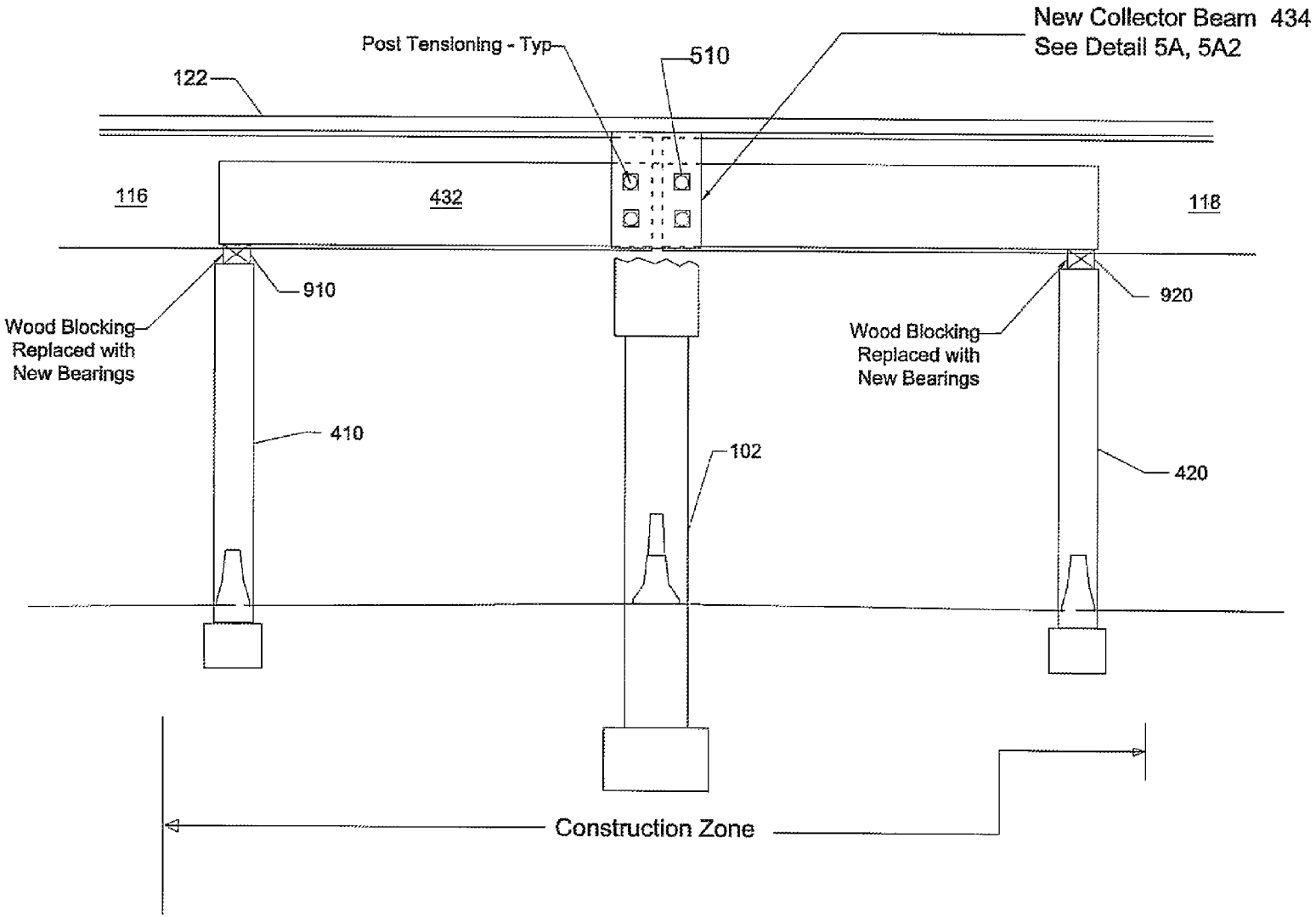

FIG. 9D depicts the new cast in place concrete collector beam 434. The collector beam 434 including its longitudinal post-tensioning that incorporates the new needle beams 432 and the load bearing ends existing bridge beams 116 and 118. The linear construction sequence includes casting the collector beam and post tensioning the collector beam; post tensioning the needle beams, which lift beams 116 and 118 off the center pier 102; replacing wood blocking with bearing pads; and demolishing the center pier.

Figure 9E:
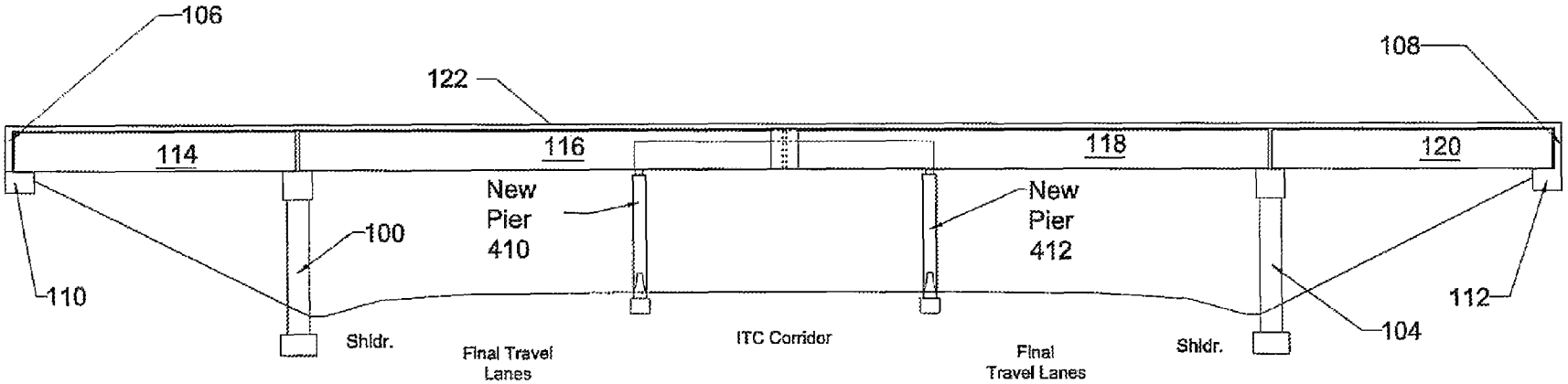

FIG. 9E shows the completed structure with the relocated pier supports that facilitate an unobstructed Independent Transportation Corridor. Construction of final transportation corridor can proceed and/or sequenced with the above bridge modifications.

In the case of the simple span steel girder overpass structure, a less complex method that does not utilize either needle beams or collector beams may be used. The first steps remain the same, where the temporary barriers 902 and 904 may be placed to protect the construction zone while shifting the traffic lanes to the outside enough to allow the installation of the new pier foundations 410F and 420F.

Figure 10:
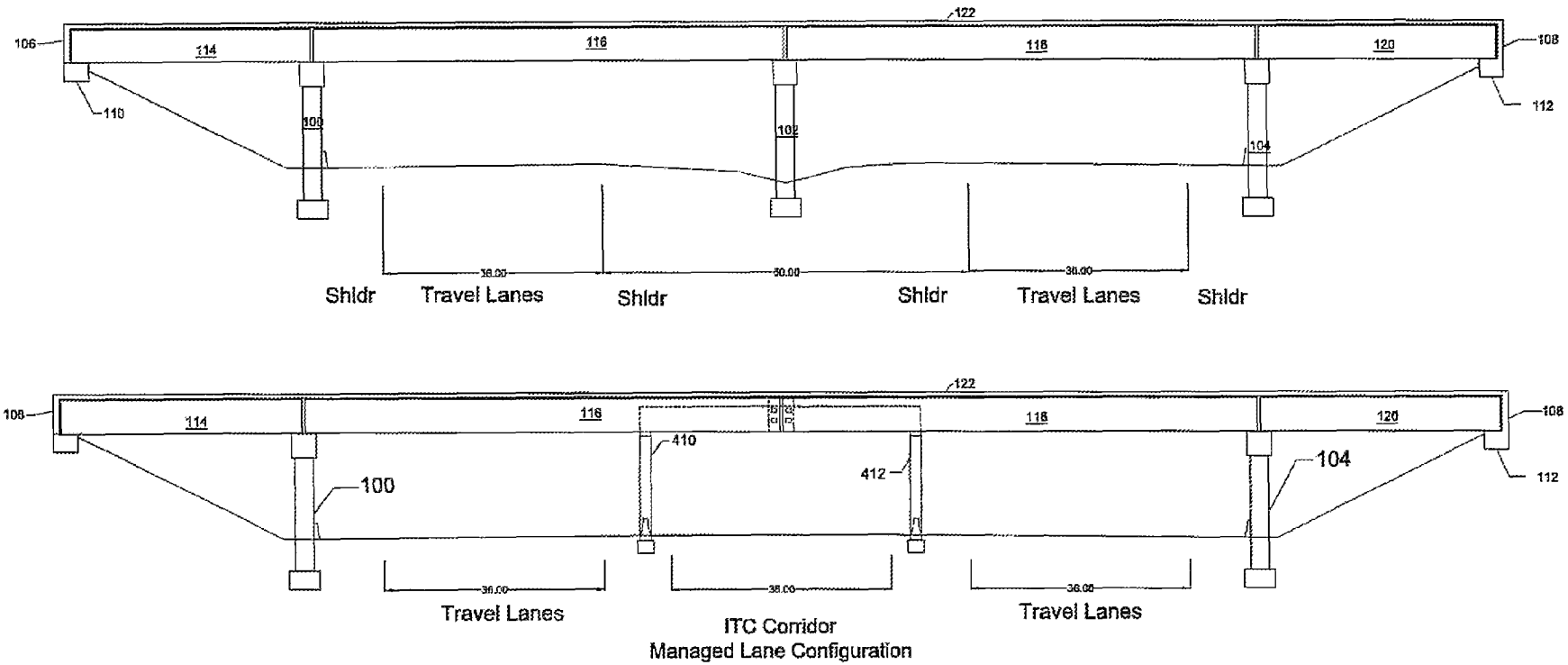
FIG. 10 illustrates the conversion of a typical limited access highway with a grass median configuration to a reversible managed lane transportation corridor

The new piers 410 & 420 may be constructed on the pier foundations 410F and 420F. New barriers 910 and 920 may be added that are collinear with the new piers that allow the temporary barriers to be removed, FIG. 10B.

At this point the existing steel girders 116 and 118 may be spliced together as shown previously in FIG. 6, using new, splice plates 616, 614, 618 and 610 as depicted in detail on FIG. 6A. New web stiffeners are installed above each new pier and each girder may be vertically jacked up to allow new bearing to be placed between the new pier and beams. The jacking process lifts the newly spliced girders off the old center pier and allows the demolition of the center pier creating the new central independent transportation corridor.

Example I

Figure 11:
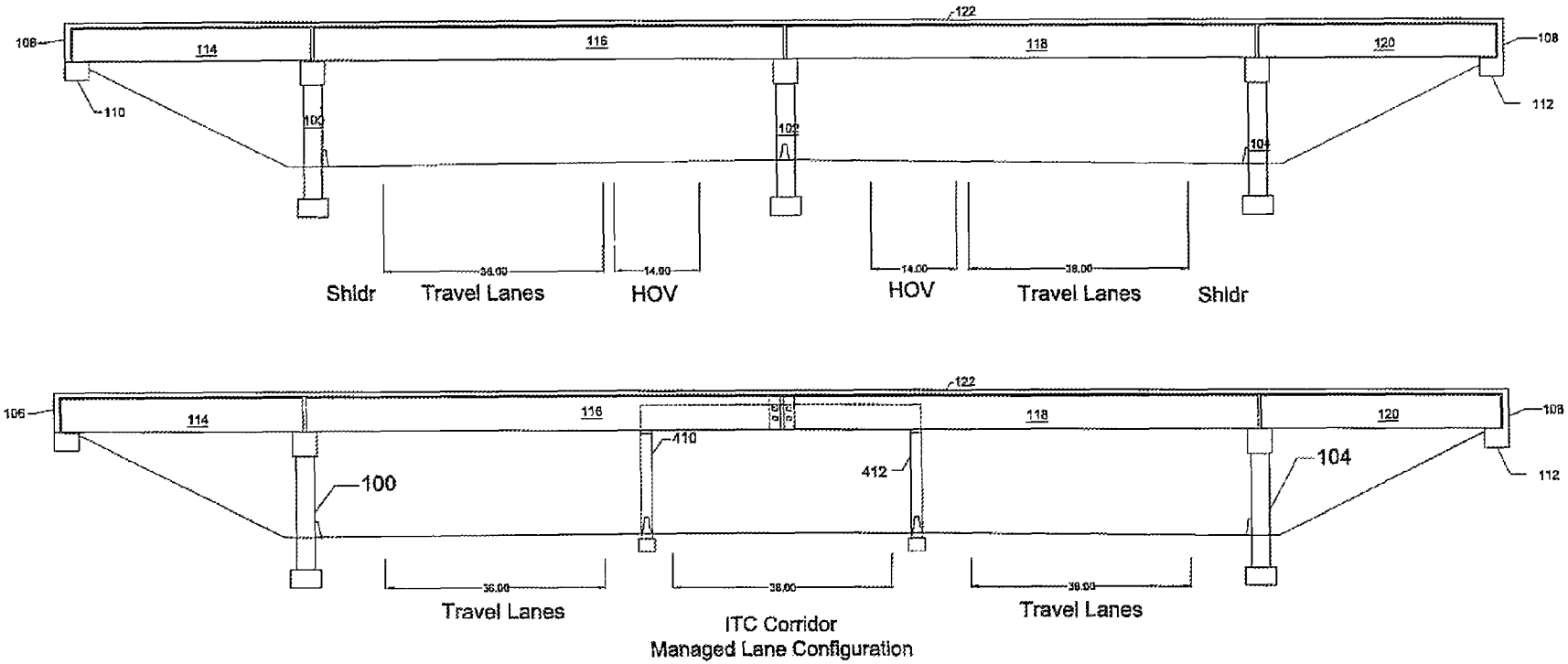
FIG. 11 illustrates the conversion of a typical limited access highway with a HOV configuration to a reversible managed lane transportation corridor

An existing limited access highway system provides two regular lanes in each direction with a grassed median in between. The modification, with dimensions, is illustrated in FIG. 11. The existing regular lanes are 12' wide. The median varies in width subject to right of way limits. Shoulders are 12' wide. By modifying the bridges and re-dimensioning the lanes, the new transportation corridor is provided with sufficient space for two regular lanes in each direction, plus three bi-directional lanes (36') in a center section; or a dual track rail corridor (25'). The bidirectional lanes may be accessed via slip ramps along the outer shoulder or direct ramp access from overpass bridges and may be provided for HOV, or for limited access toll use.

Because traffic flows vary significantly during the day, the bidirectional lanes may run in the inbound direction in the morning rush hour, and the outbound direction in the evening rush hour

Example II

Figure 12:
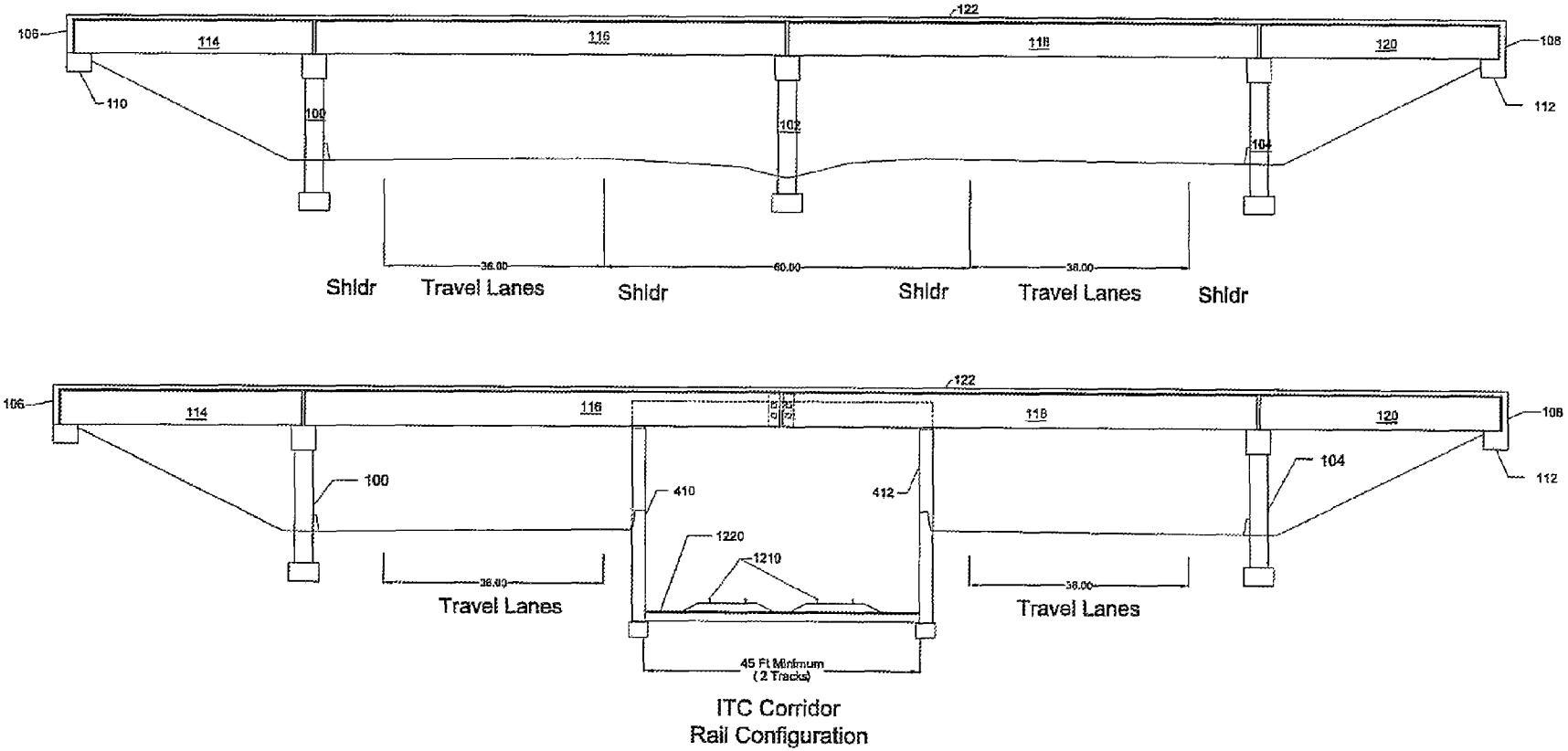
FIG. 12 illustrates the conversion of a typical limited access highway with a grass median configuration to a dual track rail transportation corridor

An existing limited access highway system in a urban setting provides various configurations subject to right-of-way restrictions but generally for example it may have three regular and 1 HOV lane in each direction. FIG. 12 illustrates the example, including dimensions. The existing regular lanes are 12' wide. The HOV lane may be 14' wide. Shoulders may be 12' wide. By modifying the bridges and re-dimensioning the lanes, the new roadway is provided with three regular lanes in each direction (36'), plus three bi-directional lanes (36') in a center section. The bidirectional lanes may be accessed via slip ramps along the outer shoulder or direct ramp access from overpass bridges, and may be provided for HOV, or for limited access toll use.

Because traffic flows vary significantly during the day, the bidirectional lanes may run in the inbound direction in the morning rush hour, and the outbound direction in the evening rush hour.

Example III

An existing limited access highway system provides three regular lanes in each direction. FIG. 12 illustrates the example, including dimensions. The existing regular lanes are 12' wide. A 50' grassy median separates the lanes going in opposite directions. Because of poor utilization of the HOV lanes in some jurisdictions, a decision is made commuter rail system, rather than HOV lanes. Two tracks 1210 may be provided on a 45' rail roadbed 1225. Because of the greater height clearance requirement of a rail system, the rail roadbed 1225 may have to be installed below grade. Appropriate subjacent support for the outer traffic lanes may be provided.

The footings for the new piers 410 and 412 may be integrated as part of the subjacent support system. The new system provides three lanes in reach direction, and replaces the center median lanes with a two track commuter rail system.

The commuter rail system may be provided without replacing the overpass bridge deck, and with minimal disruption of traffic on the bridge.

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

The invention claimed is:

1. A method of expanding a highway having a plurality of lanes in a first direction and a second plurality of lanes in a second direction opposite the first direction, the first and second pluralities of lanes passing under a highway overpass bridge having a center pier located between the first and second pluralities of lanes and a first fixed bridge support on a first outer side outwards from the first plurality of lanes, and a second fixed bridge support on a second outer side outwards from the second plurality of lanes, the center pier, the first fixed bridge support, and the second fixed bridge support supporting a superstructure comprising a plurality of horizontal simple span beams, the method comprising:

replacing the center pier with two replacement central piers having a gap there between without changing the reaction points of the existing plurality of horizontal simple span beams;

Installing a collector beam in vertical support of the existing plurality of horizontal simple span beams, the collector beam being generally transverse to the existing plurality of simple span beams; and adding at least one additional lane between the first plurality of lanes and the second plurality of lanes, passing through the gap, wherein the horizontal simple span beams are still simply supported at their original reaction points after the expansion is completed.

2. The method of claim 1, wherein at least two additional lanes are added in the gap between the two replacement central piers.

3. The method of claim 1, wherein the at least one additional lane is a bidirectional lane, configured to allow traffic direction to be changed between the first direction and the second direction.

4. The method of claim 3, wherein the first and second pluralities of lanes and the at least one bidirectional lanes all run substantially perpendicular to a longitudinal axis of the bridge deck.

5. The method of claim 1, wherein the center pier is replaced without replacing the deck of the overpass bridge.

6. The method of claim 1, wherein the at least one additional lane is added without relocating the first and second fixed bridge supports.

7. The method of claim 1, wherein the at least one additional lane is a toll lane.

8. The method of claim 7, wherein the first and second pluralities of lanes are not toll lanes.

9. The method of claim 1, wherein the at least one additional lane is a high occupancy vehicle (HOV) lane.

10. The method of claim 1, wherein the existing bridge is a simple span bridge, and the collector beam is installed at the center point in vertical support of the existing simple span beams, the collector beam being generally transverse to the existing simple span beams.

11. The method of claim 1, wherein the collector beam is vertically supported by a plurality of needle beams each passing between and parallel with two existing span beams, the needle beams being supported from below by the two replacement central piers.

12. The method of claim 1, wherein the first plurality of lanes is 3 regular lanes and a HOV lane, and the second plurality of lanes is 3 regular lanes and a HOV lane, and wherein at least one additional lane is two or more bidirectional lanes, the method further comprising:

eliminating the HOV lane in the first plurality of lanes and the HOV lane in the second plurality of lanes.

13. The method of claim 12, wherein the at least one additional lane is two bidirectional lanes.

14. The method of claim 12, wherein the at least one additional lane is three bidirectional lanes.

15. A highway overpass bridge produced by the method of claim 1.

16. The method of claim 1, wherein the span beams are concrete beams.

17. The method of claim 16, wherein the concrete beams are pre-cast concrete beams.

18. The method of claim 16, wherein the concrete beams are post tensioned.

19. The method of claim 18, wherein the concrete beams are post tensioned across one or more piers.

20. The method of claim 1, wherein the center pier is an intermediate pier in a multi-span bridge.

21. The bridge of claim 15, wherein the span beams are concrete beams.

22. The bridge of claim 21, wherein the span beams are pre-cast concrete beams.

23. The bridge of claim 21, wherein the span beams are post tensioned.

24. The bridge of claim 15, wherein the center pier is an intermediate pier in a multi-span bridge.

25. A highway overpass bridge produced by the method of claim 11.

26. A highway overpass bridge, comprising:

a bridge deck;

a first plurality of lanes running in a first direction under the bridge deck;

a second plurality of lanes running in a second opposite direction under the bridge deck;

a pair of bridge piers located between the first plurality of lanes and the second plurality of lanes;

at least one bidirectional lane running between the pair of bridge piers under the bridge deck; and a plurality of span beams, wherein the bridge is a simple span bridge, and the center points of the span beams are vertically supported by a collector beam running transverse to the span beams.

27. The bridge of claim 26, wherein the first plurality of lanes, the second plurality of lanes and the at least one bidirectional lane run substantially perpendicular to a longitudinal axis of the bridge deck.

28. The bridge of claim 26, wherein the at least one bidirectional lane is a high occupancy vehicle (HOV) lane.

29. The bridge of claim 26, wherein the at least one bidirectional lane is a toll lane.

30. The bridge of claim 26, wherein the first plurality of lanes and the second plurality of lanes are not toll lanes.

31. The bridge of claim 26, wherein the collector beam is vertically supported by a plurality of needle beams each passing between and parallel with the span beams, and where the needle beams are supported from below at each end by a respective one of the pair of bridge piers.

32. The bridge of claim 26, wherein the span beams are concrete beams.

33. The bridge of claim 32, wherein the span beams are pre-cast concrete beams.

34. The bridge of claim 32, wherein the concrete beams are post tensioned.

* * * * *